US005669929A

United States Patent [19]

Reil

[11] Patent Number: 5,669,929

[45] Date of Patent: Sep. 23, 1997

[54] INTEGRAL EAR PIERCING SYSTEM

[76] Inventor: Vladimir Reil, 32450 Nautilus Dr., Rancho Palos Verdes, Calif. 90274

[21] Appl. No.: 667,671

[22] Filed: Jun. 21, 1996

[51] Int. Cl.[6] ..... A61B 17/34

[52] U.S. Cl. ..... 606/188; 206/471

[58] Field of Search ..... 206/461, 471, 206/776, 778; 606/185, 188

[56] References Cited

U.S. PATENT DOCUMENTS

| | | | |
|---|---|---|---|
| D. 252,867 | 9/1979 | Mann | D11/76 |
| D. 273,473 | 4/1984 | Carroll | D11/86 |
| D. 347,895 | 6/1994 | Mann | D24/146 |
| 1,442,824 | 1/1923 | Renault . | |
| 3,941,134 | 3/1976 | McDonald | 128/330 |
| 3,943,935 | 3/1976 | Cameron | 128/330 |
| 4,009,718 | 3/1977 | Hastings | 128/330 |
| 4,020,848 | 5/1977 | Dicicco | 128/330 |
| 4,030,507 | 6/1977 | Mann | 128/330 |
| 4,359,015 | 11/1982 | Ritchey | 119/156 |
| 4,527,563 | 7/1985 | Reil | 128/329 R |
| 4,580,417 | 4/1986 | Sardelli | 62/12 |
| 4,613,038 | 9/1986 | Kirk | 206/461 |
| 4,644,952 | 2/1987 | Patipa et al. | 128/305 |
| 4,741,117 | 5/1988 | Fearing | 40/301 |
| 4,860,747 | 8/1989 | Sciara | 128/330 |
| 4,931,060 | 6/1990 | Aué | 606/188 |
| 4,986,829 | 1/1991 | Blomdahl | 606/188 |
| 5,004,470 | 4/1991 | Mann | 606/188 |
| 5,004,471 | 4/1991 | Mann | 606/188 |
| 5,007,918 | 4/1991 | Mann | 606/188 |
| 5,263,960 | 11/1993 | Mann | 606/188 |
| 5,350,394 | 9/1994 | Mann | 606/188 |
| 5,360,434 | 11/1994 | Mann | 606/188 |
| 5,389,105 | 2/1995 | Mann | 606/188 |
| 5,411,516 | 5/1995 | Thomas | 606/188 |

*Primary Examiner*—Glenn Dawson
*Attorney, Agent, or Firm*—Cislo & Thomas LLP

[57] ABSTRACT

An integral ear piercing system minimizes the risk of deleterious results (such as infection) and reduces the potential for trapping and/or pinching flesh during the piercing process between the earring stud post and the earring clutch flange. An earring stud post having a sloped stop prevents the trapping and/or pinching of adjacent flesh between the earring stud post and the flange of the earring clutch during the piercing process. The earring stud is held in a sterile condition inside a blister pak by a supporting base that allows manipulation of the earring ornaments without direct manual contact with the ornaments. The supporting base may be color coded to match an interchangeable earring stud holder driven by a stud gun. Several interchangeable earring stud holders may be used in the stud gun, the earring stud holders sized to match different sizes of earring stud heads. Such holders may be color coded to the supporting base and an adapter clip, the color indicating the size of the earring stud head. The stud gun end may resiliently address ear tissue or the like held between it and a second jaw by means of a spring. By engaging a stud-clutch pair, the earring stud gun may drive the earring stud post through intervening tissue to engage the earring clutch. After the piercing process, the pierced earring and clutch are readily disengaged by the stud gun to perform the same operation again on the other ear.

26 Claims, 4 Drawing Sheets

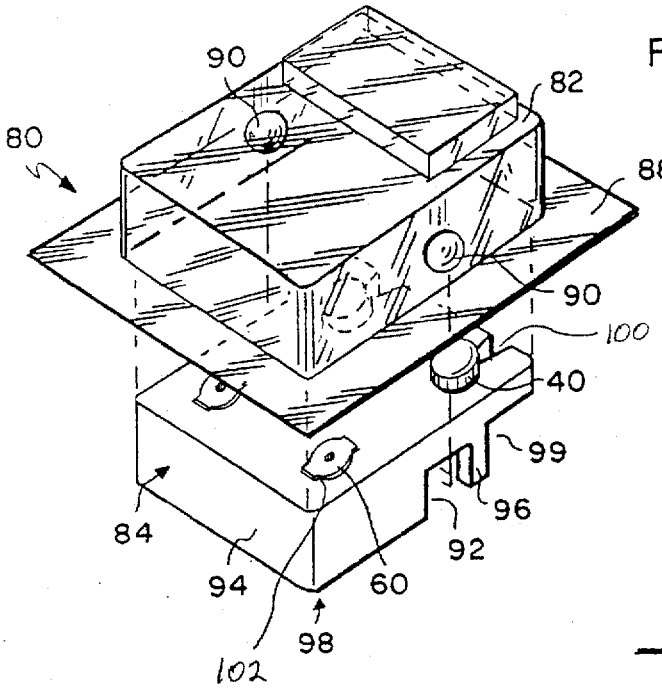
FIG. 6
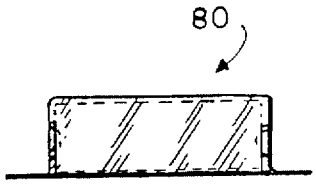
FIG. 7
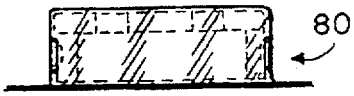
FIG. 8
FIG. 9
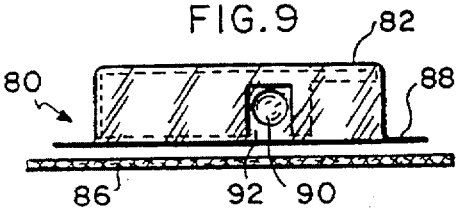
FIG. 10
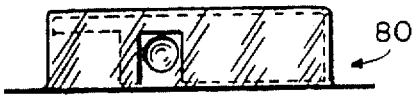
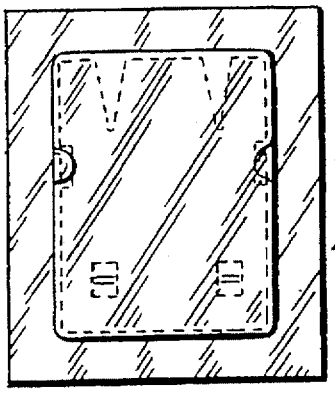
FIG. 11
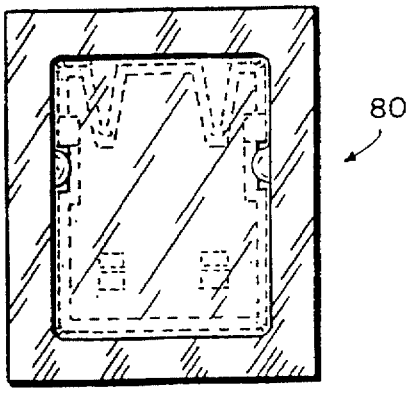
FIG. 12

128
126
120
234
110
112
118
130
240
124
114
122
149
151

120
142
146
148
144
140

190
154
184
152
162
168
112
182
166
180
128
164
160
150

180
152
112
168
162
166
170
164
154
160

190
182
112
150

172
152
112
150

180
182
170
112

172
184
152
180
182
112
190
112
150

INTEGRAL EAR PIERCING SYSTEM

BACKGROUND OF THE INVENTION

1. Field of the Invention

This invention relates to systems enabling the decorative piercing of ears and the like, and more particularly to a combined system that maintains sterility to reduce or preclude deleterious results such as infection during the ear-piercing process.

2. Description of the Related Art

The decorative piercing of ears and other body parts has been known for many years. In the past, the initial wound was created in the ear or other tissue and held open by a stud or the like until the healing process was complete. Studs or other objects then had to be used to maintain the healed wound in an open position so that the tissue would not repair the aperture formed by the healed wound.

Recently, systems for providing pierced ears have developed so that elaborate or inconvenient surgical techniques are not required in order to pierce a person's ears. One example of such a system is disclosed in U.S. Pat. No. 5,496,343 issued to Reil on Mar. 5, 1996. In that patent, a hand held disposable ear piercer is disclosed that allows a frangible tab to break when the apparatus is squeezed, forcing the earring stud through the ear and into the awaiting earring nut or clutch. The system set forth therein is a one-use disposable system that cannot be repeatedly used due to the breakable nature of the frangible tab. Other systems also exist but have been subject to several problems that prevented the sterile piercing of a person's ear in an easy and repeatable manner.

The sterile nature of the instruments used in piercing a person's ear is important, but the risk of deleterious results is generally minimal or non-existent.

Contamination of the instruments and/or earrings used in an ear-piercing system may arise in several places. Generally, people do not pierce their own ears as it is difficult to reach around to the side of one's head where one cannot directly visually inspect and monitor the piercing process. Generally, only mirrors or other reflected images could be used for such visual monitoring. Additionally, there is a tendency for one to flinch when inflicting pain upon oneself, such pain accompanying the ear-piercing process as it entails the puncturing of the ear or other tissue.

As such, it is common practice for another, second person to pierce a person's ears. Generally, such a second person's hand is more steady and direct visual monitoring of the process is more easily achieved.

As other persons generally perform the piercing process, such persons 'hands' must be clean in order to promote a sterile environment adjacent the piercing procedure and the puncture wound. Furthermore, the instruments used to accomplish the ear-piercing process must also be clean and sterile. Generally, such instruments include the working end of a stud gun that is used to propel an earring stud through the ear and into an awaiting earring clutch. The earring stud itself must be sterile and is perhaps the most important part of the process which must be sterile. The post of the earring stud travels through the ear flesh and a sterile earring stud thereby avoids inoculating any adjacent flesh with any germs, bacteria, or viruses that may be present on the surface of the earring stud post. Such inoculation is avoided by bathing or washing the adjacent area near the piercing studs.

In the past, sterility of the earring, stud, and clutch could be achieved by an antiseptic bath or the like. However, such baths may be inconvenient and unappealing especially if the ear-piercing procedure is performed by a stranger familiar with the practice upon someone who might be hesitant to have their ear or ears pierced in the first place. While the person piercing the ears may be confident that all the instruments and tools are sterile, one who is unfamiliar with the piercing process or the surroundings under which the ears are being pierced may seek reassurance in an established procedure that enhances sterility and reduces and minimizes the risk of deleterious results.

Stud guns generally used in ear-piercing procedures often have jaws or the like that serve to compress and hold steady the ear or other flesh during the piercing process. Such jaws are generally open for the easy insertion of the ear tissue but then close in order to compress the ear and hold it steady. As there are as many different thicknesses of ears as there are people, it would be to good advantage to provide moveable jaws in an earring stud gun that accommodated different thicknesses of ears so as to provide for better engagement of the ear during the piercing process. Moveable jaws, without more, generally accommodate only a certain percentage of the population with respect to their ear thicknesses as such jaws generally provide for a certain minimum distance between the jaws at the point of maximum closure. Somehow providing accommodating or adjusting means by which other ear thicknesses could be engaged would enhance the operation of an earring stud gun and better facilitate the ear piercing the process.

It has also come to recent attention that the tissue pierced by the earring stud post during the piercing process can occasionally become trapped and/or pinched between the flange of the earring clutch and a stop generally present on the stud post that serves to halt the movement of the earring clutch up towards the head of the earring stud. Generally, earring stud posts have a pointed end for easier passage through the ear. Following the piercing point of the earring stud post is a narrowed or constricted section that serves to engage the curled springs behind the flange of the earring clutch. This narrowed section then proceeds into the main post section by an abrupt, generally right angled, stop that has a tendency to trap and/or pinch tissue between itself and the earring clutch flange.

The trapping and/or pinching of tissue between the earring stud post at the aforementioned abrupt stop and the earring clutch flange may serve to increase the chances of irritation and discomfort on the part of the person who is having an ear or other tissue pierced.

As can be seen from the foregoing, certain advances can be made in providing a more sterile environment, instruments, and tools for the ear-piercing process, better engagement of the ear by jaws of a earring stud gun, and in preventing the trapping and/or pinching of pierced tissue flesh between the earring clutch flange and the earring stud post.

SUMMARY OF THE INVENTION

The present invention resides in an integral ear-piercing system that provides greater sterility of the instruments, tools, and objects used during the ear-piercing process, better engagement of the ear or other tissue to be pierced by a set of operable jaws, and reduce the chances the tissue may be trapped and/or pinched between the earring stud post and the earring clutch flange.

In order to provide enhanced sterility for the instruments, objects, and tools used in an ear-piercing process, it is advantageous to ensure that there be no direct handling of the earring stud with its piercing post and the accompanying earring clutch. In the integral ear-piercing system of the present invention, a blister pak is used to seal a supporting base that holds and supports a pair of earring studs and corresponding earring clutches. The blister pak keeps and holds the earring studs and clutches in a sterile environment and the base allows the earring ornaments (earring studs and clutches) to be manipulated without handling. Upon breaking the seal provided by the blister pak about the supporting base, the supporting base is resiliently but removably retained by the blister pak. A pair of opposing flexible dimples are present in the cover of the blister pak that resiliently engage notches present in the supporting base. Only by intentionally removing the supporting base from the cover of the blister pak will the earring ornaments be available for insertion into the ear or other tissue.

The supporting base itself provides means by which manipulation may be made of the earring ornaments without contaminating them by contact with the hands.

The earring stud of the present invention held by the supporting base includes a sloped stop which gradually intermediates the narrower clutch spring portion with the main post portion of the earring stud post. As the slope stop and the earring stud post of the present invention does not present an abrupt face to the earring clutch flange, the chances that the earring stud post will trap and/or pinch flesh between it and the earring clutch flange are reduced. As the earring stud post is maintained in a sterile environment with its corresponding earring clutch, the reduction in the chances the tissue will be caught between the earring stud post and the earring clutch serves to reduce the chances of deleterious results that may arise during the ear-piercing process.

In order to enhance the utility of the present invention, the stud gun used to pierce the ear or other tissue with the sterile earring ornaments from the blister pak has opposing and movable jaws. These jaws include a spring that serves to better and more snugly engage the ear and to better hold it in place during the piercing process. Furthermore, a wider range of engageable ear widths are available to the stud gun for ear piercing as ears of thinner widths or thicknesses may be snugly engaged while those ears of thicker widths or thicknesses compress the spring without discomfort to the person whose ear is being pierced.

The stud gun also includes interchangeable earring stud holding members that are color coded to the base of the blister pak so that the size or shape of the earring stud is easily matched with the corresponding holding member used in the stud gun. The color coding extends to adapter clips which provide convenient engagement and disengagement of the interchangeable earring stud holding members with the stud gun.

The adapter clip engages the stud gun and the interchangeable earring stud holding member so that the interchangeable earring stud holding member may be conveniently and easily engaged and disengaged with the stud gun. The adapter clip has a stud holder engagement means for stably engaging and holding the interchangeable earring stud holder. The stud holder engagement means is coupled to adapter means for snugly fitting and engaging with the stud gun. The adapter clip aligns and positions the interchangeable earring stud holder with respect to the stud gun so that the stud gun may engage the interchangeable earring stud holder. When the interchangeable earring stud holder is engaged with the stud gun, the adapter serves to conveniently fit about the interchangeable earring stud holder and maintains it in a stationary disposition as the stud gun disengages the interchangeable earring stud holder. Upon disengagement by the stud gun, the interchangeable earring stud holder is held by the adapter clip. Both the adapter clip and the interchangeable earring stud holder may then be removed from the stud gun. The adapter clip may be used for holding and storage of the interchangeable earring stud holder. As mentioned above, the adapter clip may also be color coded so that upon visual inspection, the adapter clip indicates the size of earring stud that will fit in the interchangeable earring stud holder held by the adapter clip.

By opening the blister pak and manually removing the supporting base from the blister pak cover, the earring ornaments may be placed into pre-sterilized holding means or holders for corresponding earring stud and earring clutch pieces. The ear may then be sterilized. The stud gun addresses the ear and by pulling the trigger on the stud gun, the aligned earring stud and earring clutch are quickly brought together with the earring stud post piercing the ear, travelling therethrough, and fitting into the aperture present in the earring clutch. With the ear suddenly, safely, and reliably pierced, an antiseptic can be used to "set" the wound so that upon healing, an ornamental aperture available to earring studs and the like may be formed.

OBJECTS OF THE INVENTION

It is an object of the present invention to provide an integral ear piercing system that enhances sterility of the ear-piercing process.

It is another object of the present invention to provide an integral ear piercing system that reduces the likelihood that ear tissue will be trapped and/or pinched between the earring stud post and the earring clutch.

It is an additional object of the present invention to provide a sterile package within which a set of pierced earrings may be provided.

It is another object of the present invention to provide such a sterile package that retains a supporting base inside the sterile package (although the seal has been broken) until intentionally and manually removed by a person performing the ear-piercing process.

It is another object of the present invention to provide graspable or other manual means by which the supporting base may be engaged without contact between the earring ornaments and other objects such as a person's hands.

It is yet another object of the present invention to prevent accidental contamination of sterile of earring ornaments by removably retaining a supporting base within a sterile container once the seal of the sterile container has been broken.

These and other objects and advantages of the present invention will be apparent from a review of the following specification and accompanying drawings.

BRIEF DESCRIPTION OF THE DRAWINGS

FIG. 6 shows a top perspective view of the blister pak top and supporting base, with supporting base shown in projected distance from the blister pak top.

FIG. 7 shows a rear plan view of the blister pak shown in FIG. 6.

FIG. 8 shows a front plan view of the blister pak shown in FIG. 6.

FIG. 9 shows a right side plan view of the blister pak shown in FIG. 6 with the blister pak bottom spaced apart from and below the blister pak top.

FIG. 10 shows a left side plan view of the blister pak of FIG. 6.

FIG. 11 shows a top plan view of the blister pak of FIG. 6.

FIG. 12 shows a bottom plan view of the blister pak of FIG. 6.

DESCRIPTION OF THE PREFERRED EMBODIMENT(S)

Figure 1:
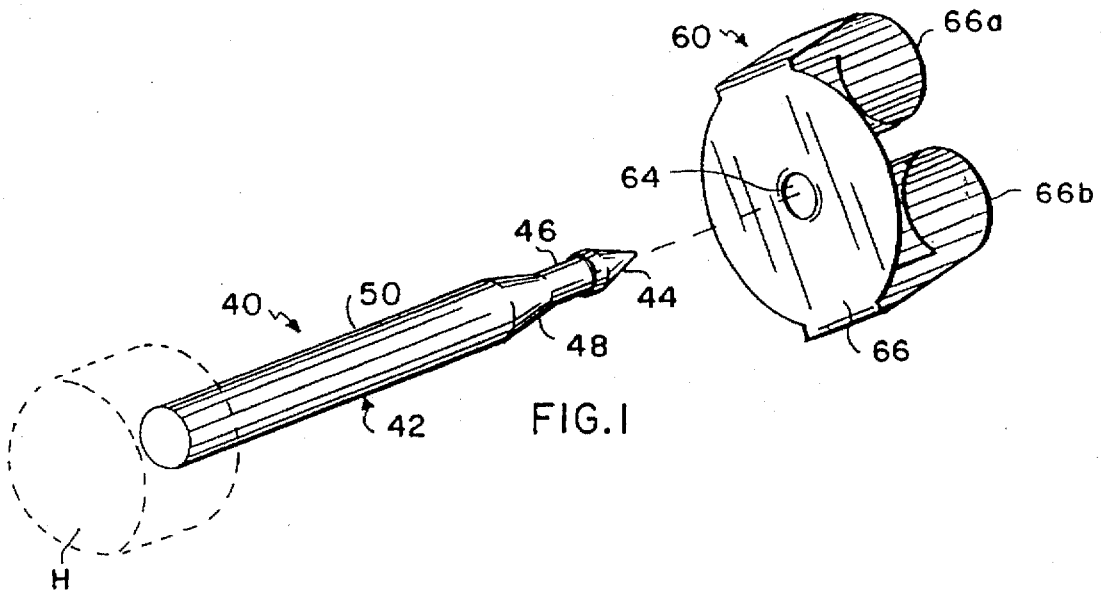
FIG. 1 shows a rear perspective view of the earring stud post with the sloping stop of the present invention opposite to a pierced earring clutch, the head of the pierced earring stud head shown in phantom.
Figure 2:
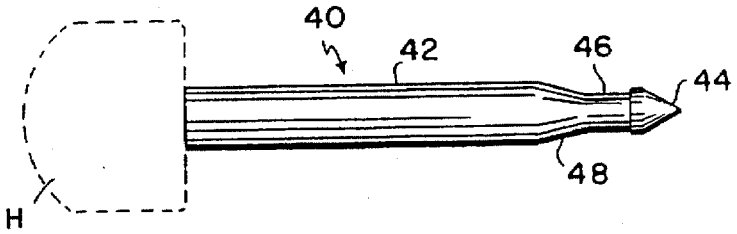
FIG. 2 shows a side plan view of the pierced earring stud post of the present invention and FIG. 1 with the stud head showing phantom.
Figure 3:
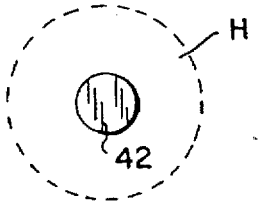
FIG. 3 shows a rear plan view of the pierced earring stud of FIG. 1 with the earring stud shown in phantom.
Figure 4:
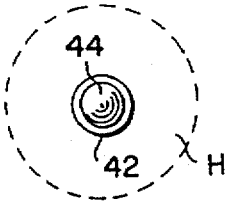
FIG. 4 shows a front plan view of the earring stud of FIG. 1 with the stud head shown in phantom.
Figure 5:
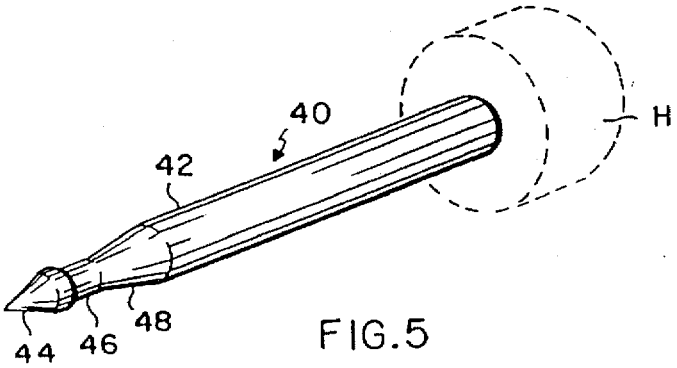
FIG. 5 shows a front perspective view of the earring stud post of FIG. 1 with the earring stud head shown in phantom.

Referring now to the drawings, the present invention resides in an integral ear piercing system that by its combination of elements provides enhanced and advantageous means by which sterile operating conditions can be created and maintained for piercing an ear or similar fleshy tissue.

Additionally, the risk of deleterious results is reduced by reducing the likelihood that flesh will be trapped and/or pinched between an earring stud post and the corresponding pierced earring clutch. Furthermore, different thicknesses of ears or similar tissue are better engaged by a stud gun end having a spring by which different ear thicknesses can be snugly engaged.

Referring now to FIG. 1, a pierced earring stud 40 is shown with the head portion H in phantom. The earring stud 40 has a stud post 42 that extends perpendicularly from the stud head H. At the end of the stud post 42 opposite the head H is a piercing point 44 that has a sharp tip capable of piercing fleshy tissue such as ears and the like.

Immediately preceding the piercing point 44 is a short segment of the stud post 42 generally narrower than the other sections of the stud post 42, namely the clutch spring post 46. The clutch spring post 46 serves to engage the pierced earring clutch as set forth in more detail below. Preceding the clutch spring post 46 is a sloping stop 48 which is preceded by a main post section 50 that constitutes the predominate portion of the stud post 42.

The sloping stop 48 generally mediates the transition between the clutch spring post 46 and the main post 50. In a preferred, but not exclusive, embodiment, the sloping stop 48 may form an angle of approximately 15 degrees with respect to the main axis (not shown) of the stud post 42. The slope of the sloping stop may be approximately 39 thousandths of an inch (0.039") in length. These dimensions are consistent with a main stud post of approximately 48 thousandths of an inch (0.048") in diameter and a clutch spring post 46 of approximately 28 thousandths of an inch (0.028") in diameter. Other diameters known in the art or similarly useful with respect to pierced earring studs 40 are contemplated in the present invention.

Also shown in FIG. 1, is a pierced earring clutch 60, such clutches generally corresponding to pierced earring studs 40 as is generally known in the art of pierced earrings. The clutch 60 has a flange 62 surrounding a central aperture 64. The piercing point 44 of the post 42 easily passes through the aperture 64. However, the main post 50 does not easily pass through the aperture 64. The diameter of the aperture 64 being less than the diameter of the main post 50. As the clutch spring post 46 has a diameter smaller than the widest diameter of the piercing point 44, the clutch spring post 46 also easily passes through the aperture 64.

Extending from opposite sides of flange 62 are oppositely opposed clutch springs **66*a*, 66*b*. The clutch springs 66*a*, 66*b* are each generally a single spiral of thin metal that resiliently retains the main post 50 upon the ear. The removable, but stable, engagement provided by the clutch springs 66*a*, 66*b* is provided by the nestling of the clutch springs 66*a*, 66*b* in the clutch spring post area 46 between the abutting sloping stop 48 and the piercing point 44. As the widest portion of the sloping stop 48 has the same diameter as the main post 50, the aperture 64 at some point is entirely filled by the abutting sloping stop 48. Generally, the point at which the flange 62 encounters the sloping stop 48 is adjacent or beyond the point where the clutch spring 66*a*, 66*b* engage the clutch spring post 46. In this way, the pierced earring clutch 60 can securely, but removably, engage the pierced earring stud 40 on the stud post 42**.

It should be noted that the sloping stop 48 does not provide an abrupt abutment against which the flange 62 may come to rest when the pierced earring stud 40 is inserted into the aperture 64. Frequently, the match between the clutch spring post section 46 of a post 42 and the clutch springs is not close or tight. With prior earring studs, such mismatching generally forces the clutch springs against the rear portion of the piercing point to force the flange of the earring clutch against the sharp abutting portion intermediating the clutch spring post with the main post. Under such circumstances, tissue, especially the tissue of a newly-formed wound, may be entrapped and/or pinched between the flange area adjacent the aperture and the main post with its sharp abutment. The trapping or pinching of the ear can lead to problems not the least of which is discomfort and possible other deleterious results. The sloping stop 48 of the present integral ear piercing system serves to reduce such pinching or possible entrapment of flesh between the earring stud 40 and the earring clutch 60'.

The blister pak portion of the present invention is shown in FIGS. 6 through 12.

The blister pak 80 of the present invention has three main components: the clear top 82, the earring-supporting base 84, and the sealing bottom 86. The supporting base 84 may be inserted into the blister pak top 82 and then sealed therein by adhesively attaching the blister pak bottom 86 to the perimeter flange 88 of the blister pak top 82. Sterilization gas (such as ethylene oxide) or the like may be injected or sealed inside the blister pak 80 during the sealing process thereby sterilizing the supporting base 84 and its contents, including the earring studs 40 and the earring clutches 60. When the blister pak bottom 86 is peeled away from the perimeter flange 88 of the blister pak top 82, the seal of the blister pak 80 is broken and the earring ornaments must quickly be used in order to avoid and reduce contamination.

When the blister pak bottom 86 is removed from the blister pak top 82, the supporting base 84 would generally have a tendency to fall out of the blister pak top 82 by the force of gravity or the like. In the present invention, flexible dimples 90 present on the sides of the blister pak top 82 fit into corresponding notches 92 present in the supporting base 84. The flexible dimples 90 hold the supporting base 84 in place as the engagement of the dimples 90 with the notches 92 prevent the inadvertent disengagement of the supporting base 84 with the blister pak top 82.

In order to remove the supporting base 84 from the blister pak top 82, the perimeter flange 94 of the supporting base 84 not only provides means by which the earring stud posts 42 may be held up and away from any underlying surface, but a portion of the base's perimeter flange 94 beneath the earring clutches 60 provides means by which the base 84 may be grasped and manipulated without touching or contaminating any of the earring ornaments, namely the earring studs 40 and the earring clutches 60. A shield 96 or the like separates an area 98 adjacent flange 94 and beneath the earring clutches 60 from the area 99 below the stud heads H adjacent the stud posts 42. The shield 96 prevents the proprietor's or other person's fingers from inadvertently engaging the posts 42 of the earring studs 40 while the proprietor grasps the perimeter flange 94.

In order to facilitate disengagement with the supporting base 84 by the earring ornaments, an earring stud holding slot 100 serves to allow access to the earring stud head H while preventing contamination of the earring stud 40. Additionally, the earring clutches 60 are held in place by means of a slot 102 divided by a clutch bar. The clutch bar is generally centered within the clutch slot 102 beneath the clutch aperture 64. The clutch bar is inserted between the two clutch springs **66*a*, 66*b* in order to provide secure placement for the earring clutch 60**.

Figures 13, 14, 15, 16, 17, 18, 19, 20, 21:
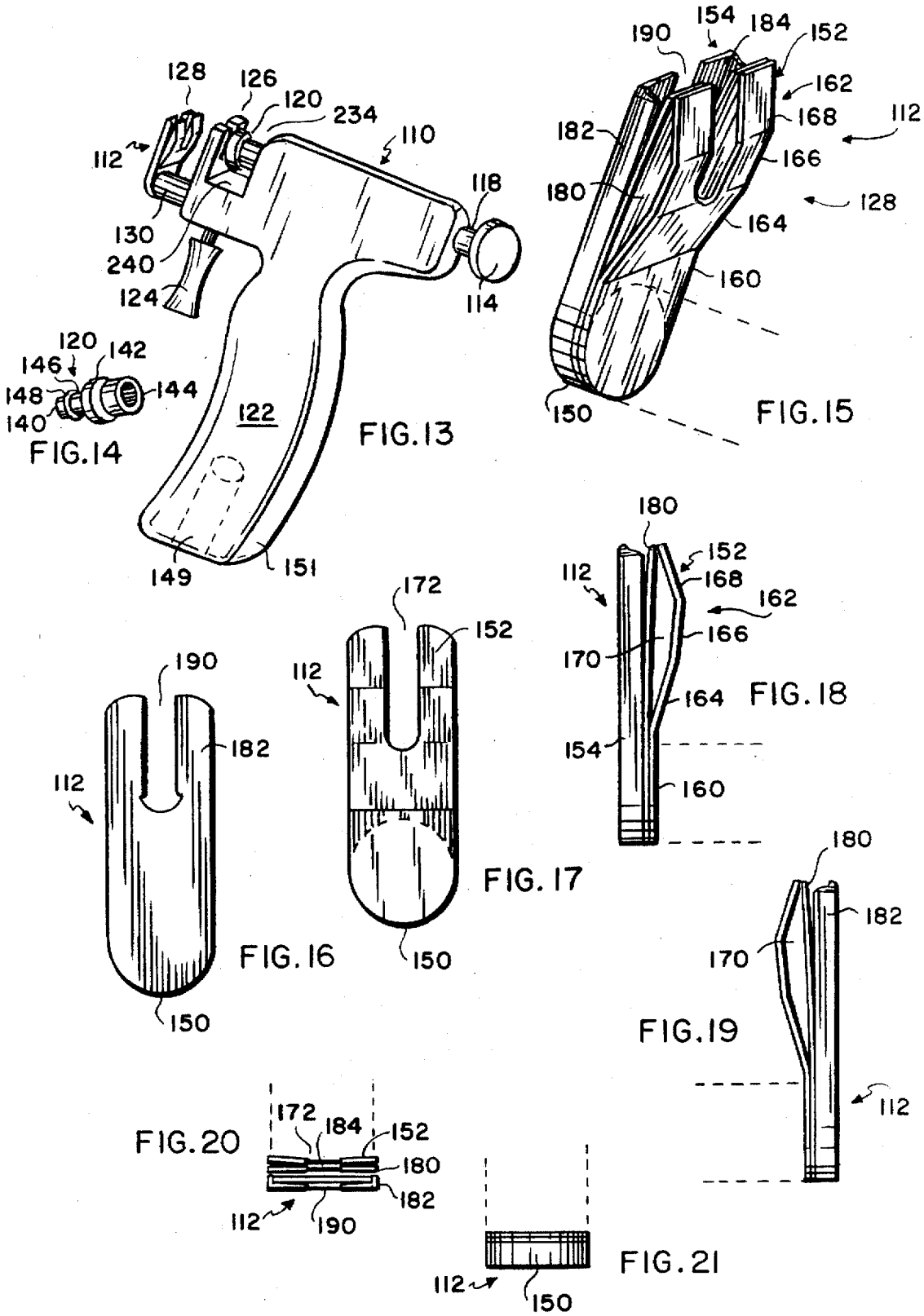
FIG. 13 shows a perspective view of a stud gun used in conjunction with the present invention.
FIG. 14 shows an interchangeable earring head engagement means or cartridge for use with the stud gun of FIG. 13.
FIG. 15 shows a stud gun end with spring for holding an earring clutch.
FIG. 16 shows a rear plan view of the stud gun end of FIG. 15.
FIG. 17 shows a front plan view of the stud gun end of FIG. 15.
FIG. 18 shows a right side plan view of the stud gun end of FIG. 15.
FIG. 19 shows a left side plan view of the stud gun end of FIG. 15.
FIG. 20 shows a top plan view of the stud gun end of FIG. 15.
FIG. 21 shows a bottom plan view of the stud gun end of FIG. 15.
Figure 22:
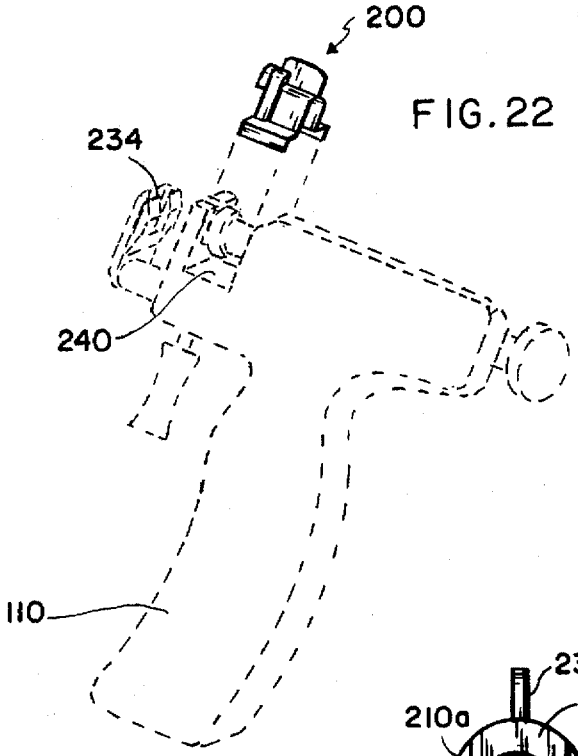
FIG. 22 shows an upper rear perspective view of the adapter clip of the present invention. The stud gun to which the adapter clip fits is shown in phantom.
Figure 23:
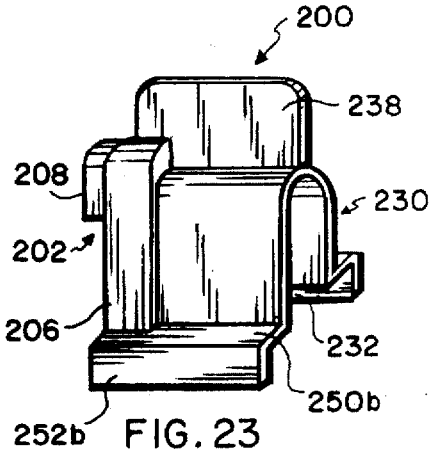
FIG. 23 shows an upper rear perspective view of the adapter clip of the present invention.
Figure 24:
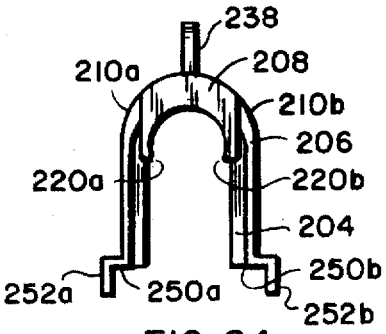
FIG. 24 shows a front elevational view of the adapter clip of FIG. 23.
Figure 25:
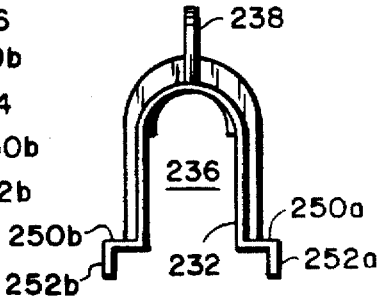
FIG. 25 shows a rear elevational view of the adapter clip of FIG. 23.
Figure 26:
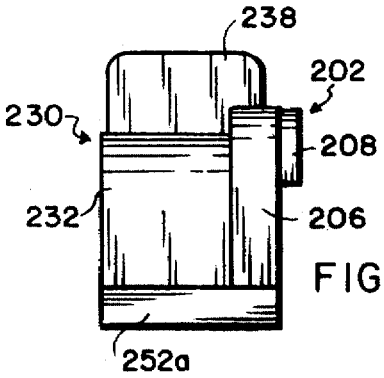
FIG. 26 shows a right side elevational view of the adapter clip of FIG. 23.
Figure 27:
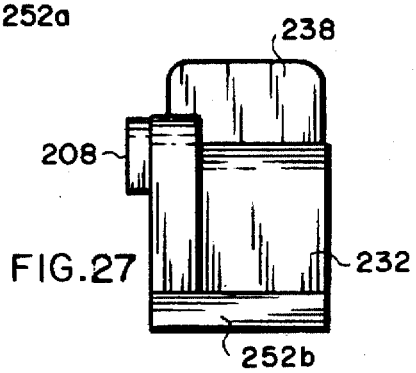
FIG. 27 shows a left side elevational view of the adapter clip of FIG. 23.
Figure 28:
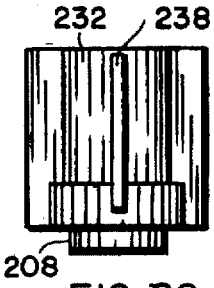
FIG. 28 shows a top plan view of the adapter clip of FIG. 23.

As shown in FIG. 13, the integral ear piercing system of the present invention also comprises a stud gun 110 to which is attached a special stud gun end 112. The stud gun 110 is of a design generally known in the art and serves to deliver pierced earring stud 40 to the earring clutch 60 during the piercing process. The stud gun 110 holds in aligned positioning the earring stud 40 and clutch 60.

The operation of the stud gun as used in the integral ear piercing system of the present invention is set forth in more detail below. The stud gun 110 is a spring loaded and triggerable device that uses the restoring force of a spring or the like to drive the pierced earring stud through the ear during the piercing process and into the pierced earring clutch. As this procedure entails the breaking of the skin and the creation of an intentional wound, it is important that this process be made as safe as possible by providing the least risk of deleterious results and the best circumstances to preserve sterility of the instruments, objects, and tools used during the piercing procedure.

In order to cock the stud gun 110, the plunger 114 is pulled back and away from the main body 116 of the stud gun 110. In doing so, the plunger pulls against a spring (not shown) until a spring-biased catch or the like (also not shown) engages the pin 118 that travels through the main body 116 of the stud gun 110. At the end of the pin 118 is the interchangeable earring stud holder 120 which travels along with the pin 118 and serves as a means for engaging the earring stud head H.

The stud gun handle 122 is easily engaged by the hand as for a pistol grip. Likewise, the trigger 124 is easily engaged by the right or left hand by the index finger.

When the stud gun 110 is cocked by pulling the plunger 114, squeezing the trigger 124 serves to release the catch holding the pin 118 and allowing the plunger 114, the pin 118, and the earring stud holder 120 to travel forward towards the inner jaw 126 very quickly. As the plunger 114, pin 118, and earring stud holder 120 may be made of steel or other dense materials, the quick and rapid travel of the stud driving mechanism (plunger 114, pin 118, earring stud holder 120) generates a relatively large momentum. This momentum can create very high pressures, especially when such momentum is brought to bear on the piercing point 44 of the pierced earring stud 40. When the trigger 124 is squeezed, it brings the outer jaw 128 towards the inner jaw 126. By bringing the inner 126 and outer 128 jaws together, ear tissue or other tissue may be snugly engaged between the two jaws to stabilize and secure it during the piercing process.

In fact, it is only the last millimeter or so of travel by the trigger 124 that releases the catch holding the cocked stud driving mechanism. As such, it is possible to secure the ear or other tissue between the two jaws 126, 128 and reposition the jaws so that the preferred location of the piercing for the earring stud is chosen. By squeezing the trigger 124 the last millimeter or so, the stud driving mechanism is released and the spring forces the stud driving mechanism forward to pierce the ear and place the earring stud post 42 in engagement with the earring clutch 60.

While this process is very quick, there is generally some pain involved for the person undergoing the piercing process and the quick nature of the stud gun in executing the piercing process serves to ensure consistent and reliable ear piercings under sterile and clean conditions. As shown in the drawings, the outer jaw 128 includes the stud gun end 112. The outer jaw 128 is coupled to the trigger 124 by outer jaw shaft 130.

As shown in FIG. 14, the interchangeable earring stud holder 120 is generally a plug shaped device that may serve three purposes: providing a secure cradle for the head H of the pierced earring stud 40, providing secure engagement means with the stud gun pin 118, and providing quick and preferably visual means of identifying which size pierced earring stud head H the earring stud holder 120 fits.

As set forth in more detail below, the adapter clip 200 of the present invention may also be color coded in a manner similar to that of the interchangeable earring stud holder 120.

In the earring stud holder 120 of FIG. 14, a first and rear shaft 140 extends to a first flange (not shown) and collar 142. The flange is present beneath the collar 142 and supports it. Beyond the collar 142, and opposite the rear shaft 140, a stud head holder or dog 144 projects forwardly in line with the rear shaft 140. The stud head holder 144 is cup-shaped or otherwise configured to hold the head H of the pierced earring stud 40. The fit between the earring stud head H and the stud head holder 144 should be close without being difficult to insert or remove the earring stud head H. The stud head holder 144 should hold the earring stud head H and the earring stud 40 in such a manner so that lateral movement or angular movement of the earring stud 40 within the stud head holder 144 is avoided. Such off-centering movements may destructively affect the alignment of the earring stud 40 with the earring clutch 60 when the two are engaged by the stud gun 110.

While several earring stud holders 120 may be associated with a single stud gun 110, each holder 120 having different sizes of stud head holders 144, the rear shafts 140 of each of the earring stud holders 120 are similarly sized and shaped in order to be received by the stud gun pin 118.

The rear shaft 140 of the earring stud holder 120 has a channel 146 circumscribing the rear shaft 140. Within the channel 146, a gasket 148 is held and protrudes slightly past the generally uniform diameter of the rear shaft 140. The gasket serves to securely engage the pin 118 near its operating end so that the earring stud holder cartridge 120 is securely and stably held by the stud gun 110. The pin 118 is hollow near its end to receive the interchangeable earring stud holder 120.

The collar 142 may be dyed or otherwise colored to match the color of the supporting base 84. If earring studs 40 are organized and/or sorted so that only certain specific sizes or earring stud heads H are associated with certain colors of bases 84, using the same color on the earring stud engagement means indicia collar 142 serves as a convenient and quick means by which to size the earring stud head H according to the earring stud holder 120 and its accompanying stud head holder 144. Persons performing ear piercing operations using the stud gun 110 can then look to the base, match it with the color of the indicia collar 142 and immediately have the right size stud head holder 144 to engage the earring stud head H for that base's color. The adapter clip 200 is also the same color as the indicia collar 142 and the base 84 to ensure coordination between the earring studs and the interchangeable holders 120.

Additionally, the indicia collar 142 may act as a stop or stop means, preventing the further forward travel of the earring stud holder 120 towards the outer jaw 128. At the end of its forward travel, indicia collar 142 will engage the inner jaw 126 to prevent further forward travel of the earring stud holder 120 and pin 118.

In order to provide varying sizes of stud head holders 144, a plurality of earring stud holders 120 may accompany the stud gun 110. By using a hollow tube whose diameter is the same as that of the operating end of the pin 118, a pair of differently sized (and differently colored at the indicia collar 142) earring stud holders 120 can be stored in the butt 151 of the stud gun 110 in a chamber 149 provided there. A covering cap (not shown) over the chamber 149 can be used to hold the unused holders 120 in the stud gun 110 until such sized earring stud holders 120 are required for use. Colors that may be used for the bases 84 and the indicia collars 142 include beige, pink, and white.

FIGS. 15 through 21 show the stud gun end 112 that forms the outer jaw 130 of the stud gun 110. The stud gun end 112 has three main components: a shaft attaching end 150, an ear or other tissue engaging spring 152, and earring clutch engagement means in the form of an earring clutch holder 154. The stud gun end 112 can be formed in layers so that extensions of the spring 152 and the earring clutch holder 154 serve as the point of attachment of the stud gun end 112 to the outer jaw shaft 130 at the shaft attaching end 150.

As shown in FIGS. 15 and 18, the spring 152 has a lower extension 160 extending from the main spring portion 162. The main spring portion 162 has a lower section 164 that angles outwardly from the plane of the stud gun end 112 towards the direction of the outer jaw shaft 130. A middle section 166 continues the outward travel of the spring 152 but at a reduced angle to that of lower spring section 164. A top section 168 angles back towards the plane of the stud gun end 112 and terminates adjacent the terminal end of the earring clutch holder 154.

Due to the flexibility of the spring 152 and the gap 170 between the spring 152 and the earring clutch holder 154 the spring may flex if compressed to resiliently return to its initial position once the compression is ceased. Such compression generally occurs when ear or other tissue is held between inner 126 and outer 128 jaws.

Centrally located generally along the top 168 and middle 166 sections of the spring 152 is a spring slot 172 through which the piercing point 44 of post 42 of the pierced earring stud 40 may pass in order to engage the earring clutch 60 held by the earring clutch holder 154. Corresponding gaps are present in the earring clutch holder 154. The spring slot 172 may descend into the top portion of the lower spring section 164.

The earring clutch holder 154 has a front flange retaining member 180 that blocks off the from earring clutch cradle 182. The flange retaining member 180 of the earring clutch holder 154 is generally a thin piece of metal with a slot 184 allowing exposure of the clutch aperture 64 to the piercing point 44 of the earring main post 42. The flange retaining member 180 is generally attached to the stud gun end 112 at the shaft attaching end 150 so that the opposite end of the flange retaining member is able to flex resiliently towards and away from the earring clutch cradle 182. The resilient flexing of the flange retaining member 180 allows for easy disengagement of the stud gun end 112 from the earring clutch 60 once an ear has been pierced by the stud gun 110. Also, flexing allows different sizes of earring clutches 60 to be reasonably accommodated by the stud gun end 112.

The earring clutch cradle 182 of the earring clutch holder 154 has a slot 190 that corresponds to the flange retaining member slot 184 and the spring slot 172 as shown by the correspondence of the slots in FIGS. 16 and 17. The clutch cradle 182 may support the earring clutch 60 by its flange 62 above the lower most portion of the clutch cradle slot 190. The clutch cradle serves to position the aperture 64 of the clutch 60 in aligned opposition with the piercing point 44 of earring stud 40 when engaged by the stud gun 110. As both the clutch aperture 64 and the stud piercing point 44 are generally small, this alignment is important to ensure that the earring stud 40 properly and consistently engages the clutch 60.

The earring clutch 60 is retained between the clutch cradle 182 and the flange retaining member 180. However, the uppermost portion of the clutch holder 154 is open for the easy insertion and removal of the earring clutch 60. Furthermore, the clutch cradle slot 190 allows the clutch springs 66*a*, 66*b* to protrude therethrough to ensure that the clutch flange 62 is loosely, but stably, engaged by the stud gun end 112 via the clutch holder 154. Generally, gravity alone holds the earring clutch 60 within the clutch holder 154 and the clutch 60 can easily slide up and down within the clutch holder 154. This allows for easy disengagement of the earring clutch 60 by the clutch holder 154 once the piercing process has been completed.

As shown in FIGS. 22–29, an adapter clip 200 removably fits upon the stud gun 110. As shown in FIGS. 23–29, the adapter clip 200 has a stud holder engagement means 202 that is adapted to hold the interchangeable earring stud holders 120. In order to hold the stud holders 120, the stud holder engagement means 202 has a collar shoulder 204 that engages the stud holder collar 142. Surrounding the collar shoulder 204 is the collar shoulder flange 206 which surrounds the collar shoulder 204 on one side about the exterior of the collar shoulder 204.

Projecting forwardly of the collar shoulder 204 and spaced apart therefrom is a stud head holder clip 208 having a pair of extending clip fingers 210*a*, *b*. Extending from the ends of the clip fingers 210*a*, *b* are clip finger tabs 220*a*, *b*. The clip finger tabs 220*a*, *b* as well as the clip fingers 210*a*, *b* serve to engage the stud holder 144. The stud head holder clip 208 has generally flat sides so that it may closely fit within the prongs of the inner jaw 126. The clip finger tabs 220*a*, *b* extend laterally on either side of the clip fingers 210*a*, *b* so that engagement may be made of both the stud holder 144 and on the interior side of the stud head holder clip 208 and the inner jaw 126 prongs on the exterior.

Figure 29:
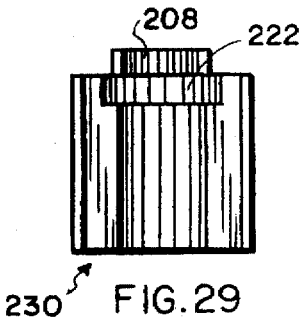
FIG. 29 shows a bottom plan view of the adapter clip of FIG. 23.

The collar shoulder 204 and the stud head holder clip 208 are spaced apart so that the indicia collar 142 of the interchangeable earring stud holder 120 may fit between the collar shoulder 204 and the stud head holder clip 208. The extending clip fingers 210*a*, *b* also serve to hold the interchangeable earring stud holder 120 in place by engaging the stud holder 144. The collar shoulder flange 206 provides additional support by the adapter clip 200 for the interchangeable holder 120 and prevents articulation of the interchangeable earring stud holder 120 while allowing easier guidance of the interchangeable holder 120 into the indicia collar groove 222 (FIG. 29).

Coupled to the stud holder engagement means 202 rearwardly thereof, an adapter 230 providing adapter means provides snug engagement of the adapter clip 200 with the stud gun 110. The adapter 230 has a housing 232 which arcs curvedly and extends behind the collar shoulder 204 so that the adapter clip 200 completely fills and is securely engaged within the gap 234 between the inner jaw 126 and the main portion of the stud gun 110. The channel or space 236 defined within the housing 232 allows the rear shaft portion 140 of the stud holder 120 to extend into the adapter clip 200. The collar shoulder 204 prevents the rearward travel of the interchangeable holder 120 into the adapter clip 200. Such rearward travel by the interchangeable holder 120 is prevented as the collar shoulder 204 engages the indicia collar 142 preventing it from traveling backwards into the adapter clip 200. In fact, the snap fit entrapment of the indicia collar 142 into the stud head holder clip 208 provides stable means for alignedly engaging the interchangeable holder 120 with the stud gun 110.

Atop the housing 232 is a gripping tab 238 which provides easier means by which the adapter clip 200 may be engaged manually when it is disengaged from the stud gun 110. The gripping tab 238 extends upwardly from the top of the housing 232 and partially engages the collar shoulder flange 206.

At opposite ends of the housing 232, oppositely opposed shoulders 250*a*, *b* extend outward perpendicularly from the housing 232. The shoulders 250*a*, *b* terminate in flanges 252*a*, *b* which extend downwardly perpendicular to the outer ends of the shoulders 250*a*, b. The flanges 252*a*, *b* are generally parallel to the ends of the housing 232 save that the flanges 252*a*, *b* are spaced apart from the housing 232 by the shoulders 250*a*, *b*.

Generally, once an interchangeable holder 120 has been fitted into the adapter clip 200, there is generally no need to otherwise manually engage or touch the interchangeable holder 120. The adapter clip 200 serves as both a carrier and a holder for the interchangeable holder 120, providing means by which the interchangeable holder 120 may be engaged to or disengaged from the stud gun 110.

As set forth above, the interchangeable holder 120 fits into the indicia collar groove 222 and is properly aligned therefor by means of the collar shoulder 204 and the collar shoulder flange 206. The collar shoulder flange 206 closely engages the outer circumference of the indicia collar 142 so that it must rest flat upon the collar shoulder 204. Such positioning of the interchangeable holder 122 by the collar shoulder 204 and the collar shoulder flange 206 serves to center the rear shaft 140 of the interchangeable holder 120 within the space 236 defined by the housing 232. When the interchangeable holder 120 is snap fit into the stud head holder clip 208, the rear shaft 140 of the interchangeable holder 120 is disposed below the top of the housing 232 so that the pin 118 may alignedly engage the rear shaft 140 of the stud gun 110.

Once the stud gun 110 has engaged the interchangeable holder 120, the snap fit previously holding the interchangeable holder 120 to the adapter clip 200 may be broken by removing the adapter clip 200 from the stud gun 110. Removal of the adapter clip 200 then leaves the interchangeable holder 120 properly in place and aligned with the stud gun, the rear shaft 140 of the interchangeable holder 120 inserted into the distal end of the pin 118.

In order to engage the interchangeable holder 120 with the stud gun 110, the stud gun 110 is disposed in a cocked position to remove the pin 118 from the stud gun gap 234. The adapter clip 200 with the interchangeable holder 120 is then fitted on to the stud gun at the gap 234 between the inner jaw 126 and the main upper portion of the stud gun 110. When so fitted to the stud gun 110, the shoulders 250*a*, *b* and flanges 252*a*, *b* engage the platform 240 at its corners. The stud head holder clip 208 snugly fits between the prongs of the inner jaw 126 and the rear end of the housing 232 abuts against the top portion of the stud gun 110.

Upon so fitting the loading the adapter clip 200 on to the stud gun 110 the handle 114 of the pin 118 is held back while the trigger 124 is pulled. The pin 118 is then slowly released to engage the rear shaft 140 of interchangeable holder 120 until the pin 118 travels as far forward as it can. The forward end of pin 118 thereby engages the rear shaft 140 of the stud holder 120. The adapter clip 200 is then removed, disengaging the snap fit with the interchangeable holder 120 and leaving the interchangeable holder 120 engaged to the stud gun.

In order to disengage the interchangeable holder 120 using the adapter clip 200, the process is reversed with the stud gun 110 and the interchangeable holder 120 disposed in an uncooked position. The adapter clip 200 is then disposed into the stud gun gap 234 as set forth above. In so doing, the adapter clip 120 snap fits around the interchangeable holder 120. The handle 114 of the pin 118 is then pulled back to dispose the stud gun 110 in a cocked condition. The interchangeable holder 120 then disengages from the distal end of the pin 118 and is held by a snap fit in the adapter clip 200. The interchangeable holder 120 is then free of the stud gun 110 and the removal of the adapter clip 200 serves to disengage the interchangeable holder 120 from the stud gun 110.

The adapter clip 200 may be set aside in a stand with other such clips holding interchangeable holders 120 as in a storage tray. The color of the adapter clip 200 should match the indicia collar 142 for its interchangeable holder 120 thereby providing easy visual means by which to identify the size of earring stud head H that fits the interchangeable holder 120 held by the adapter clip 200.

As mentioned previously, the color of the bases 84 of the blister paks 80 generally match the collars 142 of interchangeable holders 120 that fit the earring studs held by the bases 84. The color of the adapter clips 200 holding the interchangeable holders 120 should also match the indicia collar 142 as well as the bases 84 for the corresponding earring stud heads H so that easy visual means may be provided by the adapter clips 200 to indicate the appropriate size earring stud H for the interchangeable holder 120 held by the adapter clip 200.

Note should be taken that in engaging the interchangeable holder 120 to the stud 110 the stud gun should not be quickly released as by pulling the trigger and allowing the pin 118 to freely travel forward in a quick and rapid fashion as is true during the ear piercing process. Damage could result to the adapter clip 200 or the stud gun 110. Instead, the slow release process set forth above is preferred.

Having set forth the different elements of the integral ear piercing system of the present invention (namely, the earring stud 40 with its sloping stop 48, the blister pak 80 with its supporting base 84 and base-retaining dimple 90 and notch 92 system, the stud gun 110 with its interchangeable earring stud holders/engagement means 120 and stud gun end 112, and the adapter clip 200), the operation of the integral ear piercing system is as follows to provide easy, safe, and consistently sterile means by which ears or other similar tissue may be pierced for decorative and/or cosmetic purposes.

Initially, the customer chooses a set of pierced earrings according to his or her preference or fancy. The proprietor of (as contemplated) the retail establishment where the earrings are purchased may sell the chosen earrings to the individual. As the top 82 of the blister pak 80 in which the earrings are sold is clear, the color of the associated base 84 is readily ascertainable. As mentioned previously, the supporting base and the associated earring ornaments are maintained under sterile conditions due to the sealed nature of the blister pak 80.

Upon ascertaining the general size of the earring stud head H by visual inspection of the color of the supporting base 84, the proprietor may then fit the stud gun 110 with the appropriately sized earring stud holder/engagement means 120 according to the appropriate indicia collar 142 on the holder 120. The indicia collar 142 should match the color of the supporting base 84. As set forth above, the color of the adapter clip 200 also matches the color of the supporting base 84 and the indicia collar 142 so that easy visual identification may be made of the interchangeable holder 120 appropriate for the earring stud held by the supporting base 84.

The working end of the stud gun 110 (particularly the jaws 126, 128) is then cleaned by conventional means to ensure that the least risk of complications is attained. After the appropriate earring stud holder 120 has been fitted into the stud gun pin 118 using the adapter clip 200 in the engagement process described above, and the working end of the stud gun 110 has been sterilized, the stud gun is cocked by pulling out the plunger as described above. The seal on the blister pak 80 is then opened by removing the sealed blister pak bottom 86 to expose the bottom portion of the supporting base 84. The flexible dimples 90 in the blister pak top 82 prevent the supporting base 84 from disengaging with the top 82 due to the engagement of the flexible dimples 90 with the notches 92 present in the base 84.

The base 84 may be removed from the blister pak top 82 by manually grasping the graspable flange 94 generally circumscribing the base 84 adjacent the earring clutches 60. By manually engaging both the blister pak top 80 as by its perimeter flange 88 and the base 84 by its base perimeter 94, the supporting base 84 may be removed from the blister pak top by overcoming the engagement between the flexible dimples 90 and the notches 92. The earring ornaments (studs 40 and clutches 60) are then exposed and should immediately be used.

Upon removal from the blister pak 80, the earring ornaments are then engaged by the stud gun 110 as follows. After the stud gun 110 is cocked, the earring stud head H is inserted into the earring stud holder 120. The earring stud 40 is then removed or disengaged from the base 84 by pulling the earring stud 40 through the holding slot 100. The earring clutch 60 is then inserted into the earring clutch holder 154 on the stud gun end 112. The stud gun end 112 may be used to engage the clutch 60 with the clutch holder 154 picking up the clutch 60 as it disengages the clutch 60 from the supporting base 84.

The ear to be pierced is then swabbed with a sterilizing or antiseptic solution. The portion of the ear to be pierced is then placed between the inner 126 and outer 128 jaws. By pulling on the trigger 124 the outer jaw shaft 130 pulls the stud gun end 112 towards the inner jaw 126 to snugly engage the ear and hold it in place during the piercing process. Squeezing the trigger 124 through the last few millimeters of travel disengages the latch mechanism on the cocked stud gun to quickly propel the earring stud 40 towards the clutch 60. The piercing point 44 is driven through the intermediating ear tissue to engage the earring clutch 60. The sloped nature of sloping stop 48 of the earring post 40 prevents pinching or entrapment of adjacent tissue between the sloping stop 48 and the clutch 60.

The ear has now been pierced and the earring stud 40 disengages from the earring stud holder 120 when the grip on the trigger 124 is released. The outer jaw shaft 130 then travels outwardly to separate the inner 126 and outer jaws 128. By lowering the stud gun 110 from the now-pierced ear, the earring clutch 60 is freed from the earring clutch holder 154 and the piercing process is complete. The wound created by the piercing process may be swabbed by an antiseptic solution to ensure a minimal risk of deleterious results. Once the piercing wound heals, the proud owner of the newly-pierced ear and set of earrings may remove and insert the purchased pierced earring at will and without injury.

The process may be repeated on the other ear save that the blister pak need not be opened a second time. Precautions should be taken to clean the working end of the stud gun 110 and to work quickly to ensure that a minimal amount of time passes between the opening of the blister pak and the setting of the second earring in the second ear.

The description set forth above of the integral ear piercing system of the present invention has been directed generally towards ear piercing, but other body parts may also be pierced by the present invention so long as they may be suitably engaged by the stud gun 110.

While the present invention has been described with regards to particular embodiments, it is recognized that additional variations of the present invention may be devised without departing from the inventive concept.

What I claim is:

1. An integral ear piercing system for easily piercing ears in a sterile manner, comprising:

a pierced earring stud, said earring stud having a head coupled to a post, said post comprising a sloping stop for engaging a flange surrounding an aperture in a pierced earring clutch, said sloping stop sloping at an angle sufficiently gradual to avoid trapping and/or pinching flesh between said post and said clutch flange when said post pierces flesh to form a temporary wound that upon healing allows attachment of said earring stud;

a disposable and sterilizable blister pak holding said earring stud in a sterile environment until said earring stud is ready for use, said blister pak including a base for holding said earring stud and a sealed case sealingly surrounding said base and preserving said sterile environment about said earring stud until ready for use, said base having a notch and said case having a flexible dimple engaging said notch so that when said case is opened, said base is removably retained by said dimple to preserve sterility and prevent accidental contamination of said earring stud, said dimple retaining said base until said base is intentionally removed from said case;

a stud gun for piercing a body part with said earring stud, said stud gun having outer and inner jaws movable together and apart with respect to each other to snugly engage and hold still a body part for piercing with said earring stud, one of said jaws including a spring, said spring configured to resiliently engage said body part to provide better engagement by said outer and inner jaws of said body part when said outer and inner jaws move towards each other to snugly engage and hold still said body part; wherein in use, said outer and inner jaws of said stud gun being cleaned, said blister pak opened and said base removed from said case to expose said sterile earring stud, said stud gun engaging said earring stud in a sterile manner for piercing said body part, said body part made sterile before piercing; whereby said body part may be pierced in a sterile manner by said stud gun to reduce or preclude chances of deleterious results, while said sloping stop prevents tissue trapping and/or pinching between said post and said clutch flange.

2. The integral ear piercing system of claim 1, wherein said post further comprises:

a wider, main post extending from said head, said sloping stop extending from said main post;

a narrower clutch spring post extending from said sloping stop; and a piercing point coupled to said clutch spring post;

said wider main post and said narrower clutch spring post mediated by said sloping stop.

3. The integral ear piercing system of claim 2, wherein said sloping stop further comprises:

said sloping stop having a sufficiently gradual angle of approximately fifteen degrees (15°) with respect to said clutch spring post; and a slope of said sloping stop being approximately thirty-nine thousandths inch (0.039") in length.

4. The integral ear piercing system of claim 1, wherein said blister pak further comprises:

said base holding an earring clutch;

said base holding a second earring clutch; and said base holding a second earring stud; whereby said blister pak supplies two complete and sterile pierced earrings for said stud gun.

5. The integral ear piercing system of claim 4, wherein said base further comprises:

graspable means for manual engagement by a person wielding said stud gun, said graspable means coupled to said base and allowing said person to manually engage said base without destroying sterility or accidentally contaminating said earrings and said clutches held by said base.

6. The integral ear piercing system of claim 5, wherein said base further comprises:

an earring stud holding slot, said earring stud holding slot securely but releasably holding an earring stud so that when said earring stud is engaged by said stud gun, said earring stud is easily removable from a secured mount provided for said earring stud by said earring stud holding slot.

7. The integral ear piercing system of claim 6, wherein said base further comprises:

indicia corresponding to said earring stud, said indicia indicating proper engagement by said stud gun of said earring stud.

8. The integral ear piercing system of claim 7, wherein said indicia is a color.

9. The integral ear piercing system of claim 1, wherein said stud gun further comprises:

earring stud engagement means for engaging said earring stud; and earring clutch engagement means for engaging said earring clutch;

said earring clutch engagement means aligned with said earring stud engagement means; whereby said earring stud may be driven by said earring stud engagement means to pierce said body part and engage said aperture in said earring clutch.

10. The integral ear piercing system of claim 9, wherein said earring stud engagement means further comprises:

interchangeable earring stud engagement means plugs for engaging said pierced earring stud and said stud gun, said interchangeable earring stud engagement means plugs removably engaging a stud gun pin of said stud gun, each of said plugs for engaging a different type of earring stud.

11. The integral ear piercing system of claim 10, wherein said stud gun internally stores one of said plugs when not in use.

12. The integral ear piercing system of claim 11, wherein each of said plugs further comprises:

corresponding plug indicia corresponding to said plug, said plug indicia also indicating a type of earring stud corresponding to said plug.

13. The integral ear piercing system of claim 12, wherein said plug indicia is a color.

14. The integral ear piercing system of claim 12, wherein said plug indicia color further comprises:

a color corresponding to a color of said base, said base color corresponding to a size of said earring stud; whereby said person wielding said stud gun can visually determine an appropriate plug for said earring stud by matching said base color to said plug indicia color.

15. The integral ear piercing system of claim 14, further comprising:

an adapter clip for engaging and disengaging one of said interchangeable earring stud engagement means plugs with said stud gun, said adapter clip being a color the same as said plug indicia color.

16. The integral ear piercing system of claim 15, said adapter clip further comprising:

stud holder engagement means for stably engaging and holding said interchangeable earring stud engagement means plug in an aligned position with said stud gun;

adapter means for snugly fitting and engaging with said stud gun, said adapter means coupled to said stud holder engagement means; whereby said stud gun may reliably and alignedly engage and disengage the interchangeable earring stud holder by means of said adapter clip.

17. The integral ear piercing system of claim 16, wherein said stud holder engagement means further comprises:

a collar shoulder for alignedly engaging a collar on the interchangeable earring stud holder and directing disposition of the interchangeable earring stud holder with respect to the adapter clip, said collar shoulder surrounded by a collar shoulder flange, a front portion of said collar shoulder flange engaging a stud gun jaw when the adapter clip is fitted to the stud gun, said collar shoulder flange limiting forward travel of the adapter clip with respect to the stud gun; and a stud head holder clip adjacent said collar shoulder, said stud head holder clip having a pair of oppositely opposed and extending fingers for engaging opposite sides of a stud head holder, said extending fingers having tabs at ends of said extending fingers also for engaging said stud head holder, said stud head holder clip closely fitting within a jaw of the stud gun to enhance securement and aid alignment of the adapter clip to the stud gun;

said collar shoulder and said stud head holder clip relatively spaced to define a channel and to hold said interchangeable earring stud holder in alignment with the stud gun and in position for ready engagement and disengagement with the stud gun.

18. The integral ear piercing system of claim 17, wherein said adapter means further comprises:

a housing, said housing properly holding and aligning said stud holder engagement means with respect to the stud gun, a rear portion of said housing engaging the stud gun when the adapter clip is fitted to the stud gun, said rear portion limiting rearward travel of the adapter clip with respect to the stud gun;

first and second oppositely opposed shoulders, said first shoulder coupled to said housing at a first end of said housing and said second shoulder coupled to said housing at a second end of said housing, said first and second shoulders engaging the stud gun when the adapter clip is fitted to said stud gun, said first and second shoulders limiting downward travel of the adapter clip into the stud gun; and first and second flanges respectively coupled to said first and second shoulders, said first and second flanges engaging the stud gun when the adapter clip is fitted to said stud gun, said first and second flanges limiting lateral travel of the adapter clip with respect to the stud gun.

19. The integral ear piercing system of claim 18, wherein the adapter clip further comprises:

a gripping tab coupled to said adapter means, said gripping tab providing easier means by which the adapter clip may be manually engaged.

20. An integral ear piercing system for easily piercing body parts in a sterile manner, comprising:

a pierced earring stud, said earring stud having a head coupled to a post, said post comprising a wider, main post extending from said head, a sloping stop extending from said main post, said sloping stop engaging a flange surrounding an aperture in a pierced earring clutch, a narrower clutch spring post extending from said sloping stop, a piercing point coupled to said clutch spring post, said wider main post and said narrower clutch spring post mediated by said sloping stop, said sloping stop sloping at an angle of approximately fifteen degrees (15°) with respect to said clutch spring post and having a slope approximately thirty-nine thousandths inch (0.039") in length, said sloping stop slope and angle sufficiently gradual to avoid trapping and/or pinching flesh between said sloping stop and said clutch flange when said post pierces flesh to form a temporary wound that upon healing allows attachment of said earring stud to tissue adjacent said temporary wound;

a disposable and sterilizable blister pak holding said earring stud in a sterile environment until said earring stud is ready for use, said blister pak including a base for holding said earring stud and a sealed case sealingly surrounding said base and preserving said sterile environment about said earring stud until ready for use, said base having a notch and said case having a flexible dimple engaging said notch so that when said case is opened, said base is removably retained by said dimple to preserve sterility and prevent accidental contamination of said earring stud, said dimple retaining said base until said base is intentionally removed from said case, said base holding said earring clutch, a second earring clutch, and a second earring stud so that said blister pak supplies two complete and sterile pierced earrings, said base having graspable means for manual engagement by a person, said graspable means coupled to said base and allowing said person to manually engage said base without destroying sterility or accidentally contaminating said earrings and said clutches held by said base, said base holding said earring stud in an earring stud holding slot, said earring stud holding slot securely but releasably holding said earring stud so that when said earring stud is engaged, said earring stud is easily removable from a secure mount provided for said earring stud by said earring stud holding slot, said base having color indicia corresponding to said earring stud, said indicia indicating a type of said earring stud;

a stud gun for piercing body parts with said earring stud, said stud gun having outer and inner jaws movable together and apart with respect to each other to snugly engage and hold still a body part for piercing with said earring stud, one of said jaws including a spring, said spring configured to resiliently engage said body part to provide better engagement by said jaws of said body part when said jaws move towards each other to snugly engage and hold still said body part, said stud gun having earring stud engagement means for engaging said earring stud and earring clutch engagement means for engaging said earring clutch, said earring clutch engagement means aligned with said earring stud engagement means so that said earring stud may be driven by said earring stud engagement means to pierce said body part and engage said aperture in said earring clutch, said stud gun having interchangeable earring stud engagement means plugs for engaging said pierced earring stud and said stud gun, said interchangeable earring stud engagement means plugs removably engaging a stud gun pin of said stud gun, each of said plugs for engaging a different type of earring stud, said stud gun internally storing one of said plugs when not in use, each of said plugs having corresponding plug color indicia, said plug color indicia indicating a type of earring stud corresponding to said plug, said plug color indicia corresponding to a color of said base, said base color corresponding to said type of said earring stud so that said person wielding said stud gun can easily and visually determine an appropriate plug for said earring stud by matching said base color to said plug indicia color; wherein in use, said jaws of said stud gun being cleaned, said blister pak opened and said base removed from said case to expose said sterile earring stud, said stud gun engaging said earring stud in a sterile manner for piercing said body part, said body part made sterile before piercing; whereby said body part may be pierced in a sterile manner by said stud gun to reduce or preclude chances of deleterious results, while said sloping stop prevents tissue trapping between said post and said clutch flange.

21. An integral ear piercing system for easily piercing ears in a sterile manner, comprising:

a pierced earring stud, said earring stud having a head coupled to a post, said post comprising a sloping stop for engaging a flange surrounding an aperture in a pierced earring clutch, said sloping stop sloping at an angle sufficiently gradual to avoid trapping and/or pinching flesh between said post and said clutch flange when said post pierces flesh to form a temporary wound that upon healing allows attachment of said earring stud;

a disposable and sterilizable blister pak holding said earring stud in a sterile environment until said earring stud is ready for use, said blister pak including a base for holding said earring stud and a sealed case sealingly surrounding said base and preserving said sterile environment about said earring stud until ready for use, said base having a notch and said case having a flexible dimple engaging said notch so that when said case is opened, said base is removably retained by said dimple to preserve sterility and prevent accidental contamination of said earring stud, said dimple retaining said base until said base is intentionally removed from said case;

a stud gun for piercing a body part with said earring stud, said stud gun having outer and inner jaws movable together and apart with respect to each other to snugly engage and hold still a body part for piercing with said earring stud, one of said jaws including a spring, said spring configured to resiliently engage said body part to provide better engagement by said outer and inner jaws of said body part when said outer and inner jaws move towards each other to snugly engage and hold still said body part, said stud gun comprising:

earring stud engagement means for engaging said earring stud, comprising:

interchangeable earring stud engagement means plugs for engaging said pierced earring stud and said stud gun, each of said plugs for engaging a different type of earring stud, said stud gun internally storing one of said plugs when not in use, each of said plugs having corresponding plug indicia corresponding to said plug, said plug indicia also indicating a type of earring stud corresponding to said plug, said plug indicia color corresponding to a color of said base, said base color corresponding to a size of said earring stud; whereby said person wielding said stud gun can visually determine an appropriate plug for said earring stud by matching said base color to said plug indicia color; and earring clutch engagement means for engaging said earring clutch;

said earring clutch engagement means aligned with said earring stud engagement means; whereby said earring stud may be driven by said earring stud engagement means to pierce said body part and engage said aperture in said earring clutch; wherein in use, said outer and inner jaws of said stud gun being cleaned, said blister pak opened and said base removed from said case to expose said sterile earring stud, said stud gun engaging said earring stud in a sterile manner for piercing said body part, said body part made sterile before piercing; and an adapter clip for engaging and disengaging one of said interchangeable earring stud engagement means plugs with said stud gun, said adapter clip being a color the same as said plug indicia color; whereby said body part may be pierced in a sterile manner by said stud gun to reduce or preclude chances of deleterious results, while said sloping stop prevents tissue trapping and/or pinching between said post and said clutch flange.

22. The integral ear piercing system of claim 21, said adapter clip further comprising:

stud holder engagement means for stably engaging and holding said interchangeable earring stud engagement means plug in an aligned position with said stud gun;

adapter means for snugly fitting and engaging with said stud gun, said adapter means coupled to said stud holder engagement means; whereby said stud gun may reliably and alignedly engage and disengage the interchangeable earring stud holder by means of said adapter clip.

23. The integral ear piercing system of claim 22, wherein said stud holder engagement means further comprises:

a collar shoulder for alignedly engaging a collar on the interchangeable earring stud holder and directing disposition of the interchangeable earring stud holder with respect to the adapter clip, said collar shoulder surrounded by a collar shoulder flange, a front portion of said collar shoulder flange engaging a stud gun jaw when the adapter clip is fired to the stud gun, said collar shoulder flange limiting forward travel of the adapter clip with respect to the stud gun; and a stud head holder clip adjacent said collar shoulder, said stud head holder clip having a pair of oppositely opposed and extending fingers for engaging opposite sides of a stud head holder, said extending fingers having tabs at ends of said extending fingers also for engaging said stud head holder, said stud head holder clip closely fitting within a jaw of the stud gun to enhance securement and aid alignment of the adapter clip to the stud gun;

said collar shoulder and said stud head holder clip relatively spaced to define a channel and to hold said interchangeable earring stud holder in alignment with the stud gun and in position for ready engagement and disengagement with the stud gun.

24. The integral ear piercing system of claim 23, wherein said adapter means further comprises:

a housing, said housing properly holding and aligning said stud holder engagement means with respect to the stud gun, a rear portion of said housing engaging the stud gun when the adapter clip is fitted to the stud gun, said rear portion limiting rearward travel of the adapter clip with respect to the stud gun;

first and second oppositely opposed shoulders, said first shoulder coupled to said housing at a first end of said housing and said second shoulder coupled to said housing at a second end of said housing, said first and second shoulders engaging the stud gun when the adapter clip is fired to said stud gun, said first and second shoulders limiting downward travel of the adapter clip into the stud gun; and first and second flanges respectively coupled to said first and second shoulders, said first and second flanges engaging the stud gun when the adapter clip is fitted to said stud gun, said first and second flanges limiting lateral travel of the adapter clip with respect to the stud gun.

25. The integral ear piercing system of claim 24, wherein the adapter clip further comprises:

a gripping tab coupled to said adapter means, said gripping tab providing easier means by which the adapter clip may be manually engaged.

26. An integral ear piercing system for easily piercing cars in a sterile manner, comprising:

a pierced earring stud, said earring stud having a head coupled to a post, said post comprising a sloping stop for engaging a flange surrounding an aperture in a pierced earring clutch, said sloping stop sloping at an angle sufficiently gradual to avoid trapping and/or pinching flesh between said post and said clutch flange when said post pierces flesh to form a temporary wound that upon healing allows attachment of said earring stud;

a disposable and sterilizable blister pak holding said earring stud in a sterile environment until said earring stud is ready for use, said blister pak including a base for holding said earring stud and a sealed case sealingly surrounding said base and preserving said sterile environment about said earring stud until ready for use, said base having a notch and said case having a flexible dimple engaging said notch so that when said case is opened, said base is removably retained by said dimple to preserve sterility and prevent accidental contamination of said earring stud, said dimple retaining said base until said base is intentionally removed from said case;

a stud gun for piercing a body part with said earring stud, said stud gun having outer and inner jaws movable together and apart with respect to each other to snugly engage and hold still a body part for piercing with said earring stud, one of said jaws including a spring, said spring configured to resiliently engage said body part to provide better engagement by said outer and inner jaws of said body part when said outer and inner jaws move towards each other to snugly engage and hold still said body part, comprising:

earring stud engagement means for engaging said earring stud, including interchangeable earring stud engagement means plugs for engaging said pierced earring stud and said stud gun; and earring clutch engagement means for engaging said earring clutch;

said earring clutch engagement means aligned with said earring stud engagement means; whereby said earring stud may be driven by said earring stud engagement means to pierce said body part and engage said aperture in said earring clutch;

an adapter clip for engaging and disengaging one of said interchangeable earring stud engagement means plugs with said stud gun; and wherein in use, said outer and inner jaws of said stud gun being cleaned, said blister pak opened and said base removed from said case to expose said sterile earring stud, said stud gun engaging said earring stud in a sterile manner for piercing said body part, said body part made sterile before piercing; whereby said body part may be pierced in a sterile manner by said stud gun to reduce or preclude chances of deleterious results, while said sloping stop prevents tissue trapping and/or pinching between said post and said clutch flange.

* * * * *